United States Patent [19]

Grandia et al.

[11] 4,304,641

[45] Dec. 8, 1981

[54] ROTARY ELECTROPLATING CELL WITH CONTROLLED CURRENT DISTRIBUTION

[75] Inventors: Johannes Grandia, San Jose; Daniel F. O'Kane, Morgan Hill; Hugo A. E. Santini, San Jose, all of Calif.

[73] Assignee: International Business Machines Corporation, Armonk, N.Y.

[21] Appl. No.: 209,779

[22] Filed: Nov. 24, 1980

[51] Int. Cl.[3] ..... C25D 5/08; C25D 17/00

[52] U.S. Cl. ..... 204/23; 204/218; 204/228; 204/DIG. 7

[58] Field of Search ..... 204/23, 212, 218, DIG. 7, 204/228

[56] References Cited

U.S. PATENT DOCUMENTS

| | | | |
|---|---|---|---|
| 2,181,490 | 11/1939 | Lowe | 204/218 |
| 3,023,154 | 2/1962 | Hough | 204/DIG. 7 |
| 3,317,410 | 5/1967 | Croll et al. | 204/23 |
| 3,652,442 | 3/1972 | Powers et al. | 204/273 |
| 3,809,642 | 5/1974 | Bond et al. | 204/275 |
| 4,102,770 | 7/1978 | Moriarty | 204/212 |
| 4,183,799 | 1/1980 | Sellitto | 204/DIG. 7 |

FOREIGN PATENT DOCUMENTS 860299 12/1952 Fed. Rep. of Germany ..... 204/212

*Primary Examiner*—T. M. Tufariello

*Attorney, Agent, or Firm*—Joseph E. Kieninger

[57] ABSTRACT

An apparatus and a method for rotary electroplating a thin metallic film having a uniform thickness and composition throughout. The apparatus includes a flow-through jet plate having nozzles of increasing size and uniformly spaced radially therethrough, or the same sized nozzles with varying radial spacing therethrough so as to provide a differential flow distribution of the plating solution that impinges on the wafer-cathode where the film is deposited. The spacing and size of the nozzles are critical to obtaining a uniform thickness. The electrical currents to the wafer and to the thieving ring are controlled by variable resistors so as to keep the electrical current to the cathode constant throughout the plating process. In a preferred embodiment the flow-through jet plate has an anode associated therewith in which the exposed area of the anode is maintained at a constant amount during the deposition. This method can simultaneously deposit with a uniform thickness and composition elements having a minimum gap or part size of 1 micrometer or less.

9 Claims, 4 Drawing Figures

ROTARY ELECTROPLATING CELL WITH CONTROLLED CURRENT DISTRIBUTION

TECHNICAL FIELD

This invention relates to rotary electroplating and more particularly to an apparatus and method for electrodepositing a thin metallic film.

It is a primary object of this invention to provide an improved rotary electroplating cell.

It is another object of this invention to provide a rotary electroplating cell in which metal films having uniformity of thickness, composition, and magnetic properties are deposited.

It is a further object of this invention to provide a rotary electroplating apparatus in which metal films having a minimum gap or part size of 1 micron or smaller may be obtained.

BACKGROUND ART

Electroplating, because of its inherent simplicity, is used as a manufacturing technique for the fabrication of metal and metal alloy films. One of the severe problems in plating metal films arises from the fact that when a plating current is applied the current tends to spread in the electrolyte on its path from the anode to the cathode. This current spreading leads to non-uniform local current density distribution on the cathode. Thus, the film is deposited in a non-uniform fashion, that is, the thickness of the film varies in direct proportion with the current density variation at the cathode. Additionally, where metal alloy films are deposited, for example, magnetic film compositions of nickel and iron (permalloy) or nickel, iron and copper, this non-uniform current density distribution causes a variation in the composition makeup of the alloy film.

When plating is used for the purpose of making thin film electronic components such as conductors and magnetic devices such as propagation and switch elements, where both thickness and alloy composition determine the operation of the device, the uniformity of thickness and alloy composition are very important and critical. In connection with this, one distinguishes between the variations in composition of the alloy through the thickness of the film and between the variation of composition and/or thickness from spot to spot laterally over the entire plated wafer (cathode).

The patent to Croll et al, U.S. Pat. No. 3,317,410 and the patent to Bond et al, U.S. Pat. No. 3,809,642 use a flow-through anode and an anode housing with a perforate area for increasing the thickness uniformity. The patent to Powers et al, U.S. Pat. No. 3,652,442, improved the thickness uniformity by placing the electrodes in the cell such that their edges are substantially in contact with the insulating walls of the cell. These processes were advances in the state of the art and did improve the uniformity of the plating layer to an extent sufficient for use at that time.

In magnetic bubble modules all of the generator, switches, propagation elements, expander, detector, sensor and the like are made of thin permalloy elements that range in size from $<1$ micron to over 15 microns. These permalloy elements are made by either a subtractive process or an additive process. The subtractive process involves vapor depositing a layer of permalloy on a substrate and using a photoresist mask to etch the permalloy away leaving the desired permalloy pattern. A minimum gap or part size of the order of 1 micron or less is difficult to obtain due to the control of the line width needed in two processes, photolithography and ion milling. Also, redeposition of permalloy during ion milling degrades the permalloy magnetic properties.

The additive process involves applying a flash coating of permalloy on the substrate followed by depositing a photoresist mask and then plating the desired elements directly on the substrate in the mask openings. The plating directly replicates the photolithography pattern; line and gap control of the permalloy are only influenced by one process, photolithography. With the additive process, gaps or part sizes in the 1 micron or sub-micron range are obtainable. However, for the additive process to be acceptable, it is necessary to have uniform thickness, composition, and magnetic properties in the plated permalloy that have not been obtainable with the prior art plating apparati and methods described above.

BRIEF DESCRIPTION OF THE DRAWINGS

In the accompanying drawings, forming a material part of this disclosure.

DISCLOSURE OF THE INVENTION

For further understanding of the invention and of the objects and advantages thereof, reference will be had to the following description and accompanying drawings, and to the appended claims in which the various novel features of the invention are more particularly set forth.

An apparatus and method for rotary electroplating a thin metallic film having a uniform thickness and composition throughout is described. The apparatus includes a flow-through jet plate having nozzles of increasing size and uniformly spaced radially therethrough or the same sized nozzles with varying radial spacing therethrough so as to provide a differential flow distribution of the plating solution that impinges on the wafer-cathode where the film is deposited. The spacing and size of the nozzles are critical to obtaining a uniform thickness. In one preferred embodiment, the circular plate has holes that increase in size the further from the center of the plate they are. In another preferred embodiment, the holes are of a uniform size, but the distances between the holes becomes less the further away from the center of the plate that the hole is located. This serves to produce a controlled increase in flow to the wafer surface as a function of distance from the center. In this system, an increase in plating solution flow rate alone will cause a decrease in plated thickness. The electrical current to the wafer and to the thieving ring are controlled so as to keep the current ratio to the cathode constant throughout the plating process. The current ratio is kept constant by including a variable resistor in the thieving ring circuit as well as a variable resistor in the sample or cathode circuit. By proper adjustment of the two variable resistors, the resistance in the sample cathode circuit and in the thieving ring circuit are maintained at a constant level. In a preferred embodiment, the flow-through jet plate has an anode associated therewith in which the exposed area of the anode is maintained at a constant amount during the deposition. This method can simultaneously deposit with a uniform thickness and composition, elements having a minimum gap or part size of 1 micron or less.

BEST MODE OF CARRYING OUT THE INVENTION

Figure 1:
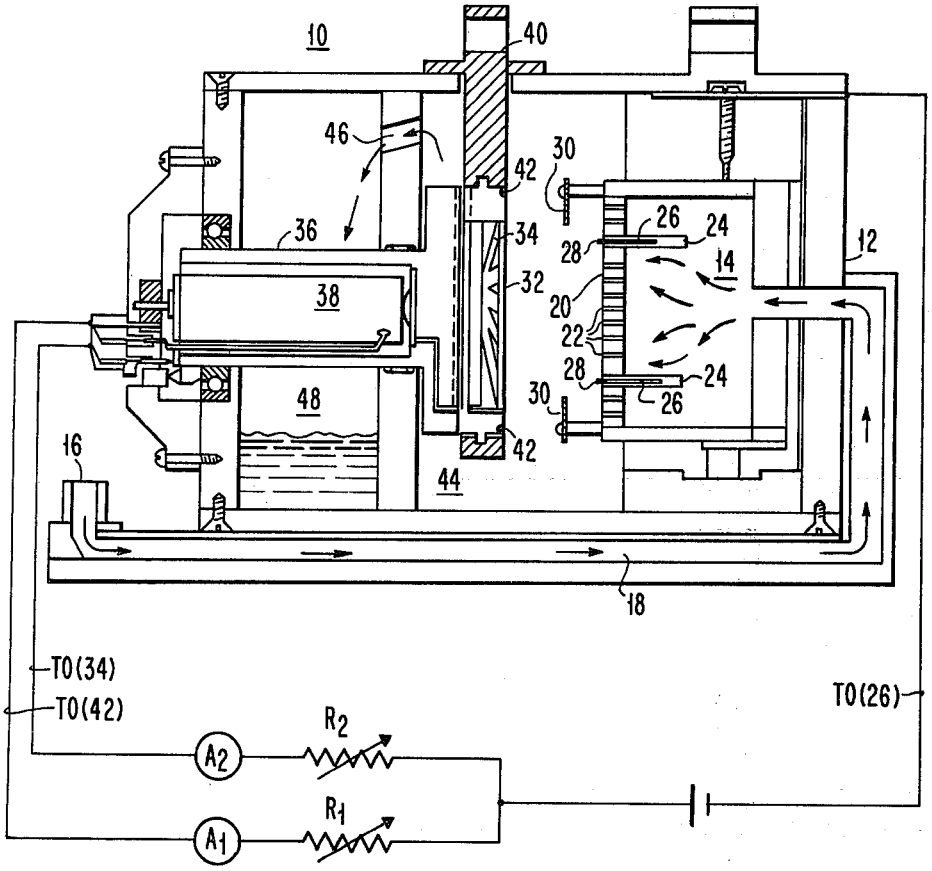
FIG. 1 is a view partly in cross-section and partly schematic of the rotary electroplating cell of this invention.

Referring to FIG. 1, the rotary electroplating cell 10 in accordance with this invention includes a tank 12 containing a chamber 14 which contains the plating solution therein. The plating solution passes through the inlet 16 through a pipe 18 to the chamber 14. On one side of the chamber 14 is a flow-through jet plate 20 having a plurality of holes or nozzles 22 therein. An anode housing 24 in chamber 14 extends through the plate 20. An anode 26 in anode housing 24 extends into the plate 20 and has an anode end 28 which protrudes beyond the plate 20.

An annular current deflector 30 is connected to end plate 20 so as to deflect the current towards the wafer 32 that is supported by the cathode 34. The cathode 34 is connected to a spindle 36 which is rotated by the motor 38. The wafer 32 may be removed by lifting the wafer carrier 40. A thieving ring 42 encircles the wafer 32. The plating solution that surrounds the wafer 32, cathode 34 and anode ends 28 is in chamber 44. The excess plating solution in chamber 44 passes through the opening 46 into a sump 48. The plating solution in sump 48 is transferred by means not shown to a tank where it is revitalized.

The cathode shown in FIG. 1 is a rotary cathode. It is also possible to use this invention with a stationary cathode if the anode and the jet plate are rotated. In addition, it is also possible to rotate both the cathode and the anode at the same time. One of the two electrode systems must be rotated.

The schematic portion of FIG. 1 shows that a variable resistor $R_2$ is connected to cathode 34; a variable resistor $R_1$ is connected to the thieving ring 42; and the circuit is completed by a connection to the anode 26. The current to the cathode 34 and thieving ring 42 are monitored by ammeters $A_2$ and $A_1$ respectively. The variable resistors $R_1$ and $R_2$ are adjusted before the plating to maintain a constant current ratio to the cathode 34 during the plating process. The size of $R_1$ and $R_2$ are considerably higher, e.g. 60Ω, than the resistance of the thieving ring and the wafer, e.g. 2Ω.

Figure 2A:
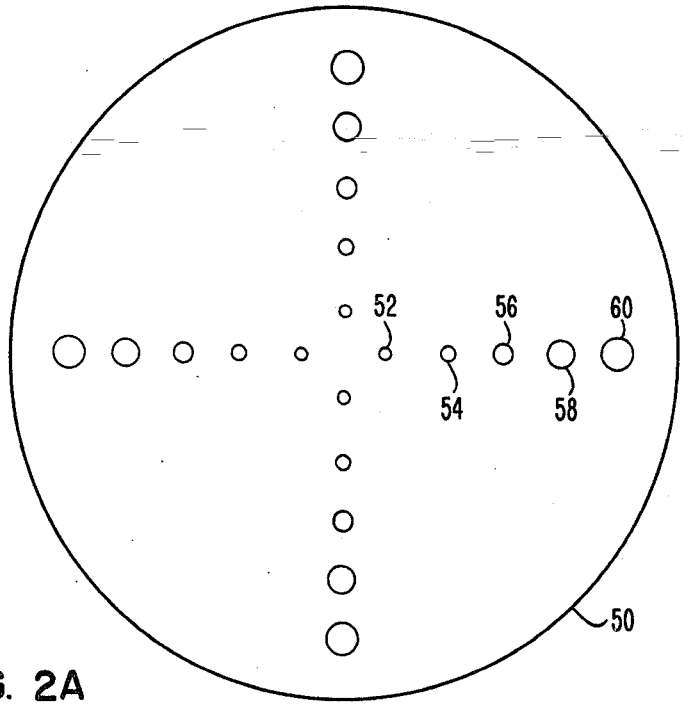
FIG. 2A is a top view of a plate having a plurality of holes that increase in size radially.

As shown in FIG. 2A, the flow-through jet plate 50 has a plurality of holes or nozzles 52, 54, 56, 58 and 60 therein which are located on a line from the center to the edge of the circular plate 50. Holes 52, 54, 56, 58 and 60 are equally spaced from each other. The size of the holes are varied with the smallest hole 52 being near the center of the plate and the largest hole 60 being near the outer edge of the plate 50. The size of the holes increases so that hole 54>52, 56>54, 58>56 and 60>58. The larger holes have a larger fluid flow which results in a thinner deposit. The smaller holes have a smaller flow which results in a thicker deposit.

Figure 2B:
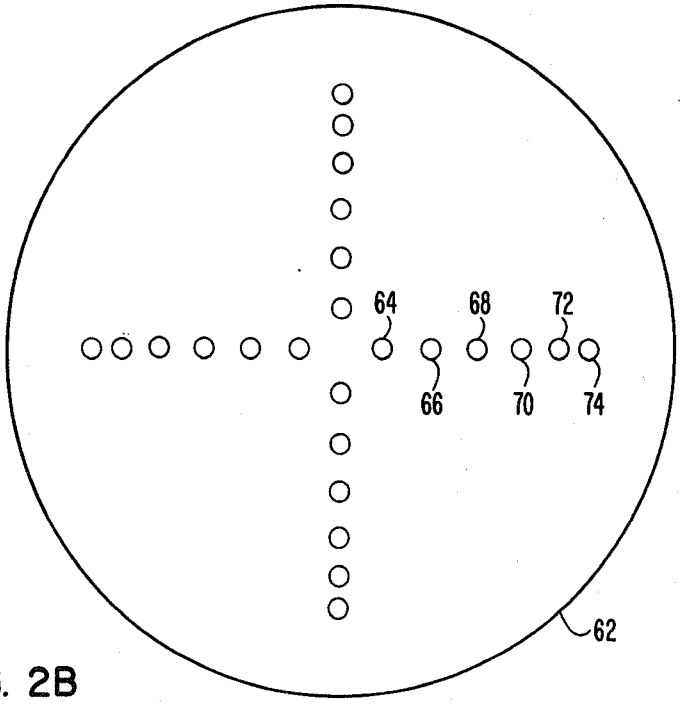
FIG. 2B is a top view of a plate having a plurality of holes that vary in spacing radially.

Another embodiment of the flow-through jet plate is shown in FIG. 2B. The plate 62 has a plurality of holes 64, 66, 68, 70, 72 and 74 on a line going from the center of the plate 62 to the outer edge thereof. The holes 64 through 74 are of an equal size. However, the holes 74 and 72 near the outer edge of plate 62 are much closer together than the holes 64 and 66 which are near the center of the plate. The distance between the holes decreases as you go from hole 64 to hole 74 causing the deposits to be thicker near the center of plate 62. Either plate 50 or plate 62, or combinations thereof, may be used in the practice of the invention.

EXAMPLE NO. 1

A gadolinium gallium garnet (GGG) wafer having a bubble supporting epilayer thereon was plated with the apparatus and method in accordance with this invention to provide a permalloy pattern thereon. The pH of the Ni-Fe plating solution was 2.50 and the temperature of the bath was 25° C. The Fe concentration of the plating solution was 1.5 g/liter and had a specific gravity of 1.039 at 25° C. The plating current was 240 mA. The plating solution was pumped through the jet plate nozzle shown in FIG. 2A to yield a plating rate of about 500 Å/min. The resistor $R_2$ going to the cathode-wafer and the resistor $R_1$ connected to the thieving ring as shown in FIG. 1 were adjusted to provide an unequal current as measured by the ammeters. The current regulated by $R_1$ was 115 mA and the current regulated by $R_2$ was 125 mA.

Figure 3:
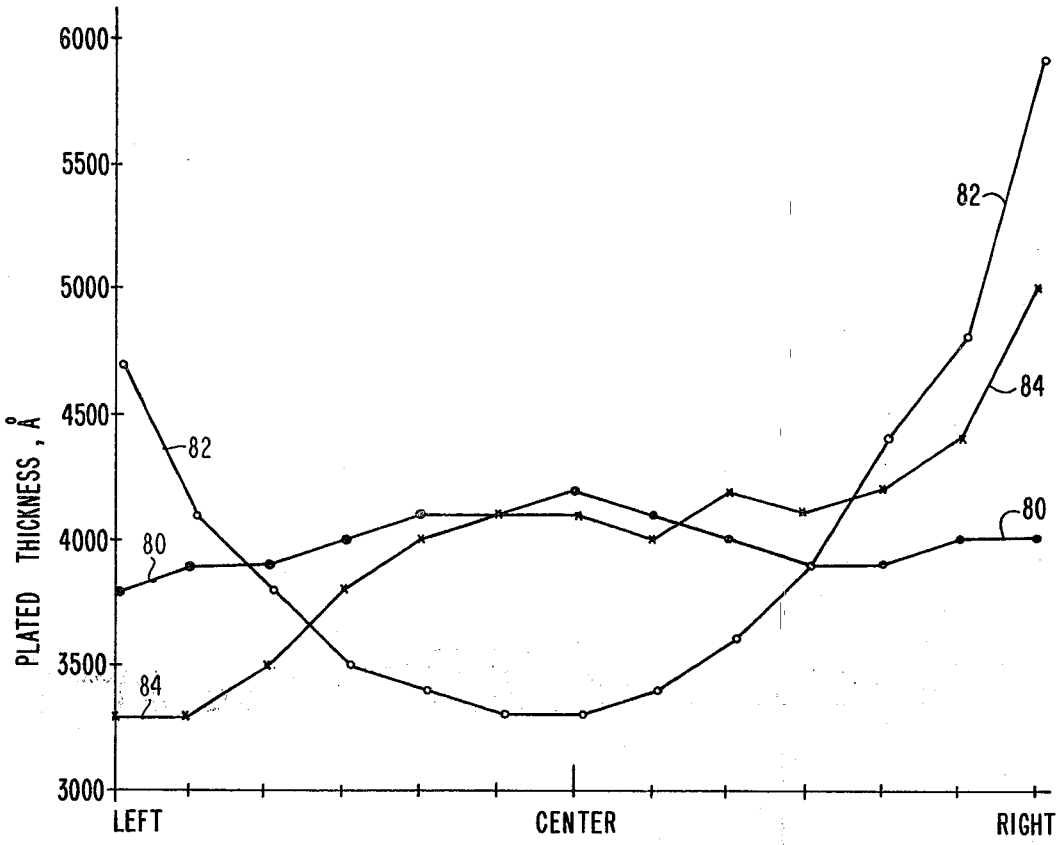
FIG. 3 is a graph comparing the thickness of a film as a function of its position across a wafer.

The thickness uniformity of the permalloy on the GGG wafer is shown in FIG. 3. The plated thickness in angstroms is plotted with respect to the position across the wafer, that is, from the left side of the wafer to the right side. The data obtained with the apparatus and process in accordance with this invention is shown by the curve 80. The thickness varied from about 3800 Å to 4100 Å. The variation was $2.75\% = 1\sigma$. In contrast, the prior art apparatus and method described under "Background Art" yielded the curve 82. The variation per curve 82 is $19\% = 1\sigma$. A modification of the prior art process yielded the curve 84 which had a variation of $11.25\% = \sigma$. The variation of thickness in the electroplated film of curve 80 enables one to plate minimum features having a size of 1 micron or less. This is clearly unobtainable with the prior art methods represented by curves 82 and 84.

The composition of the plated Ni-Fe pattern was examined at a number of positions across the wafer and found to be $14.4 \pm 0.4$ weight percent Fe ($\sigma = 0.2\%$) across the entire wafer.

The apparatus and process in accordance with this invention controls the plated thickness uniformity on wafers to be $\pm 2\sigma = \pm 6\%$. The thickness uniformity from wafer to wafer is $\pm 2\sigma = \pm 6\%$. The overall plated thickness is $\pm 2\sigma = \pm 9\%$.

While I have illustrated and described the preferred embodiments of my invention, it is understood that I do not limit myself to the precise constructions herein disclosed and the right is reserved to all changes and modifications coming within the scope of the invention as defined in the appended claims.

We claim:

1. A method for the rotary electroplating of a thin metallic film on a workpiece in a system including a cathode, anode, chamber and thieving ring comprising the steps of:

placing a flat cathode having a continuous electrical contact around the periphery thereof and in contact with said workpiece resulting in a non-uniform electrical resistance across the width of said workpiece, and passing the plating solution through a plate having a plurality of nozzles of preselected sizes therein toward said cathode whereby the size and spacing of the nozzles causes a non-uniform flow distribution of the plating solution across the cathode to produce a non-uniform current density across said workpiece which compensates for the non-uniform electrical resistance across said workpiece so as to deposit a film of uniform thickness.

2. A method as described in claim 1 including the step of providing an adjustable high resistance resistor connected to the cathode to maintain a constant current differential between the cathode and the thieving ring during the electrodeposition.

3. A method as described in claim 1 including the step of maintaining the area of the anode exposed to the plating solution at a constant area.

4. A method as described in claim 1 whereby the cathode is rotated.

5. A method as described in claim 1 whereby the anode is rotated.

6. An apparatus for the rotary electroplating of metal films having substantial uniformity of thickness and composition on a workpiece comprising a flat cathode having a continuous electrical contact around the periphery thereof and in contact with said workpiece resulting in a non-uniform electrical resistance across the width of said workpiece, and a flow-through plate in spaced relation to said cathode having a plurality of nozzles of preselected sizes for providing a non-uniform flow distribution of plating solution onto said cathode to produce a non-uniform current density across said workpiece which compensates for the non-uniform electrical resistance across said workpiece so as to deposit a film of uniform thickness.

7. An apparatus method as described in claim 6 wherein said nozzles are larger in size as the distance from the center increases.

8. An apparatus as described in claim 6 wherein the spacing between said nozzles decreases as the distance from the center increases.

9. An apparatus as described in claim 6 including a chamber adjacent to said plate for containing the plating solution, said chamber providing a non-uniform pressure of the plating solution as it flows through said chamber to said plate.

* * * * *